US012420144B2

(12) United States Patent
Sepe, Jr.

(10) Patent No.: US 12,420,144 B2
(45) Date of Patent: Sep. 23, 2025

(54) IMMERSIVE PHYSIOLOGICAL TRACKING USING OPERATOR PHYSICAL STATE AND OPERATOR MENTAL STATE

(71) Applicant: ELECTRO STANDARDS LABORATORIES, Cranston, RI (US)

(72) Inventor: Raymond B Sepe, Jr., Medfield, MA (US)

(73) Assignee: Electro Standards Laboratories, Cranston, RI (US)

( * ) Notice: Subject to any disclaimer, the term of this patent is extended or adjusted under 35 U.S.C. 154(b) by 342 days.

(21) Appl. No.: 18/090,680

(22) Filed: Dec. 29, 2022

(65) Prior Publication Data

US 2024/0216758 A1 Jul. 4, 2024

(51) Int. Cl.
*A63B 24/00* (2006.01)
*A63B 71/06* (2006.01)

(52) U.S. Cl.
CPC ..... *A63B 24/0062* (2013.01); *A63B 71/0622* (2013.01)

(58) Field of Classification Search
CPC ..... A63B 24/0062; A63B 71/0622; A63B 22/0605; A63B 22/0664; A63B 24/0087; A63B 2024/0093; A63B 2225/20; A63B 2225/50; A63B 2230/06; A63B 2230/062; A63B 2230/30
See application file for complete search history.

(56) References Cited

U.S. PATENT DOCUMENTS

| | | | | |
|---|---|---|---|---|
| 6,711,556 | B1 * | 3/2004 | Sepe, Jr. | H02P 23/14 706/2 |
| 6,792,321 | B2 * | 9/2004 | Sepe, Jr. | G05B 15/02 709/201 |
| 7,166,062 | B1 * | 1/2007 | Watterson | G16H 80/00 482/8 |
| 8,690,735 | B2 * | 4/2014 | Watterson | G16H 20/30 482/901 |
| 10,532,000 | B1 * | 1/2020 | De Sapio | A63B 24/0062 |
| 10,952,671 | B2 * | 3/2021 | Greenwald | A63B 71/06 |
| 11,141,092 | B2 * | 10/2021 | Stephens | A63F 13/212 |
| 12,176,009 | B2 * | 12/2024 | Cox | A63B 71/0622 |
| 2007/0219059 | A1 * | 9/2007 | Schwartz | A61B 5/329 482/8 |
| 2019/0283247 | A1 * | 9/2019 | Chang | A61B 5/1121 |
| 2022/0143462 | A1 * | 5/2022 | Velo | A61B 5/6895 |

(Continued)

OTHER PUBLICATIONS

Schwartz, "The Speed and the Incline of the Treadmill and the Effect on Burning Calories," https://healthyliving.azcentral.com/speed-incline-treadmill-effect-burning-calories-9523.html, Oct. 27, 2021, pp. 1-3.

(Continued)

*Primary Examiner* — Andrew S Lo
(74) *Attorney, Agent, or Firm* — IP AUTHORITY, LLC; Ramraj Soundararajan

(57) ABSTRACT

Disclosed are sensors that measure various both biological conditions and mental conditions of the trainer and on the user and adds an immersion controller into the user's system that essentially uses the exercise devices as actuators that are adjusted in order to keep both the user's physiological state and mental state tracking the trainer's physiological state and mental state.

26 Claims, 4 Drawing Sheets

(56) References Cited

U.S. PATENT DOCUMENTS

| | | | | |
|---|---|---|---|---|
| 2023/0116214 | A1* | 4/2023 | Fung | A63F 13/214 710/1 |
| 2023/0215473 | A1* | 7/2023 | Cox | A63B 22/0235 386/201 |
| 2023/0226412 | A1* | 7/2023 | Nissilä | G16H 20/30 482/9 |
| 2023/0377712 | A1* | 11/2023 | Rosenberg | G16H 15/00 |

OTHER PUBLICATIONS

Munia et al., "Mental States Estimation with the Variation of Physiological Signals," 2012 International Conference on Informatics, Electronics & Vision (ICIEV), May 2012, pp. 800-805.

Kitagawa et al., "Mental States Estimation Using ECG Affected by Mood Change During Imagining the Near Future," 2019 IEEE 1st Global Conference on Life Sciences and Technologies (LifeTech), Mar. 2019, pp. 91-92.

Peltier et al., "Developing the Third Offset: Transcranial Direct Current Stimulation Can Improve the Human Operator," Military Medicine, Jan.-Feb. 2019, vol. 184, No. 1-2, pp. 11-13.

Dittert et al., Augmentation of Fear Extinction by Transcranial Direct Current Stimulation (tDCS), Frontiers in Behavioral Neuroscience, Apr. 25, 2018, 12(76), pp. 1-16.

* cited by examiner

IMMERSIVE PHYSIOLOGICAL TRACKING USING OPERATOR PHYSICAL STATE AND OPERATOR MENTAL STATE

BACKGROUND OF THE INVENTION

Field of Invention

The present invention relates generally to the field of remotely controlled exercise equipment. More specifically, the present invention is related to a system, method, and an article of manufacture for remote immersive physiological tracking using operator physical state and operator mental state.

Discussion of Related Art

The widespread availability of high-speed Internet connections has enabled real-time remote learning and remote operation of various hardware or equipment. In the fitness industry, equipment such as exercise bikes, treadmills, rowing machines, elliptical bikes, climbers, and other types of devices are increasingly becoming network enabled allowing for a trainer to remotely lead a workout regimen with multiple participants that are not necessarily co-located.

U.S. Pat. No. 6,792,321 B2 discusses a system for real-time remote control of hardware over the Internet that can enable remote operation of exercise equipment by remotely controlling the embedded electromechanical motors and components that are used to adjust resistance, incline, speed, etc. of various fitness machines such as bikes, elliptical bikes, treadmills, climbers, and rowing machines.

U.S. Pat. No. 7,166,062 B1 discusses the remote interaction of fitness equipment with a remotely located trainer. The trainer adjusts the parameters of the user's exercise equipment in real-time to present the user with a customized workout.

FIG. 1 depicts the architecture of such prior art systems. The remotely located trainer can monitor the user's physical state (e.g., heart rate of the user) and the user's device state (e.g., speed and incline of the user's treadmill) via a data link over the Internet. The trainer may then adjust the speed and incline of his/her treadmill and reflect those parameter changes on the user's exercise device over the Internet. On the user's side of the communications link, the user's exercise device, a treadmill in this example, has its speed and incline set via the remote user parameters sent by the trainer and communicated to the user's device via the Internet. Often the trainer would set the incline and the speed of the user to follow that of his/her local exercise device but could make them different if he/she notices that the user's heart rate, for example, might be too high for a safe experience. In the prior art, the trainer is manually deciding what the parameters of the user's device should be and sets them.

While these prior art systems allow one or more users to have synchronized workouts with a remotely located trainer who can decide to adjust the parameters on each user's exercise equipment, none of them immerse the user in the same physiological experience as the trainer. The trainers may or may not be participating in the workout and, in any event, the users do not feel the same as the trainer during the workout. They do not share his physiological stress. Even if all the users are engaged on treadmills that are remotely controlled to be at the same speed and incline as the trainer, the stress on each person's body is not the same since all people sharing the session are not in the same physical condition. Factors such as age, weight, and prior training change the stress that each person feels during the same regimen. The present invention addresses these shortcomings by developing a system that allows users to get the same physiological experience as the remote operator, who is not necessarily a trainer.

Embodiments of the present invention are an improvement over prior art systems and methods.

SUMMARY OF THE INVENTION

In one embodiment, the present invention provides a system comprising: a processor; a first set of sensors, the first set of sensors monitoring a physical state associated with an operator and outputting a first set of parameters representing the physical state associated with the operator; a second set of sensors, the second set of sensors monitoring a mental state associated with the operator and outputting a second set of parameters representing the mental state associated with the operator; a network interface forwarding both the first set of parameters and the second set of parameters to a remote user, and wherein an immersion controller associated with a remote user, located remote from the operator, receives the first set of parameters associated with the physical state of the operator and the second set of parameters representing the mental state associated with the operator, and generates one or more device parameters to control a local exercise device associated with the remote user based on the received first set of parameters and second set of parameters.

In another embodiment, the present invention provides a system comprising: (a) a network interface associated with a user's exercise device receiving a first set of parameters and a second set of parameters, the first set of parameters representing a first physical state associated with a remote operator and the second set of parameters representing a first mental state associated with the remote operator; (b) an immersion controller associated with the user's exercise device, the immersion controller: (i) receiving the first set of parameters and the second set of parameters from the network interface; (ii) receiving a third set of parameters from an exercise device controller associated with the user's exercise device, the third set of parameters representing a second physical state associated with the user of the exercise device; (iii) receiving a fourth set of parameters representing a second mental state associated with the user of the exercise device; (iv) computing a fifth set of parameters from inputs received (i) through (iii), and (v) transmitting the fifth set of parameters to the exercise device controller; (c) the exercise device controller setting a sixth set of parameters in the local exercise device based on the received fifth set of parameters, the sixth set of parameters allowing the local exercise device to track both the first physical state of the remote operator and the first mental state of the remote operator.

In yet another embodiment, the present invention provides a system comprising: (a) a network interface receiving a first set of parameters and a second set of parameters, the first set of parameters representing a first physical state associated with a remote operator and the second set of parameters representing a first mental state associated with the remote operator; (b) an immersion controller associated with a local exercise device, the immersion controller comprising at least a first control channel and a second control channel, the first control channel receiving as input: the first set of parameters representing the first physical state associated with the remote operator and a third set of parameters representing a second physical state associated with a user of the local exercise device, and outputting a first control channel output; and the second control channel receiving as input: the second set of parameters representing the first mental state associated with the remote operator and a fourth set of parameters representing the second mental state associated with the user of the local exercise device and outputting second control channel output, wherein the immersion controller outputs the first control channel output and the second control channel output to an exercise device controller; and (c) the exercise device controller setting a fifth set of parameters in the local exercise device based on the received first and second control channel outputs, the fifth set of parameters allowing the local exercise device to track both the first physical state of the remote operator and the first mental state of the remote operator such that the user of the local exercise device is immersed in an experience of the remote operator.

BRIEF DESCRIPTION OF THE DRAWINGS

The present disclosure, in accordance with one or more various examples, is described in detail with reference to the following figures. The drawings are provided for purposes of illustration only and merely depict examples of the disclosure. These drawings are provided to facilitate the reader's understanding of the disclosure and should not be considered limiting of the breadth, scope, or applicability of the disclosure. It should be noted that for clarity and ease of illustration these drawings are not necessarily made to scale.

DESCRIPTION OF THE PREFERRED EMBODIMENTS

Figure 1:
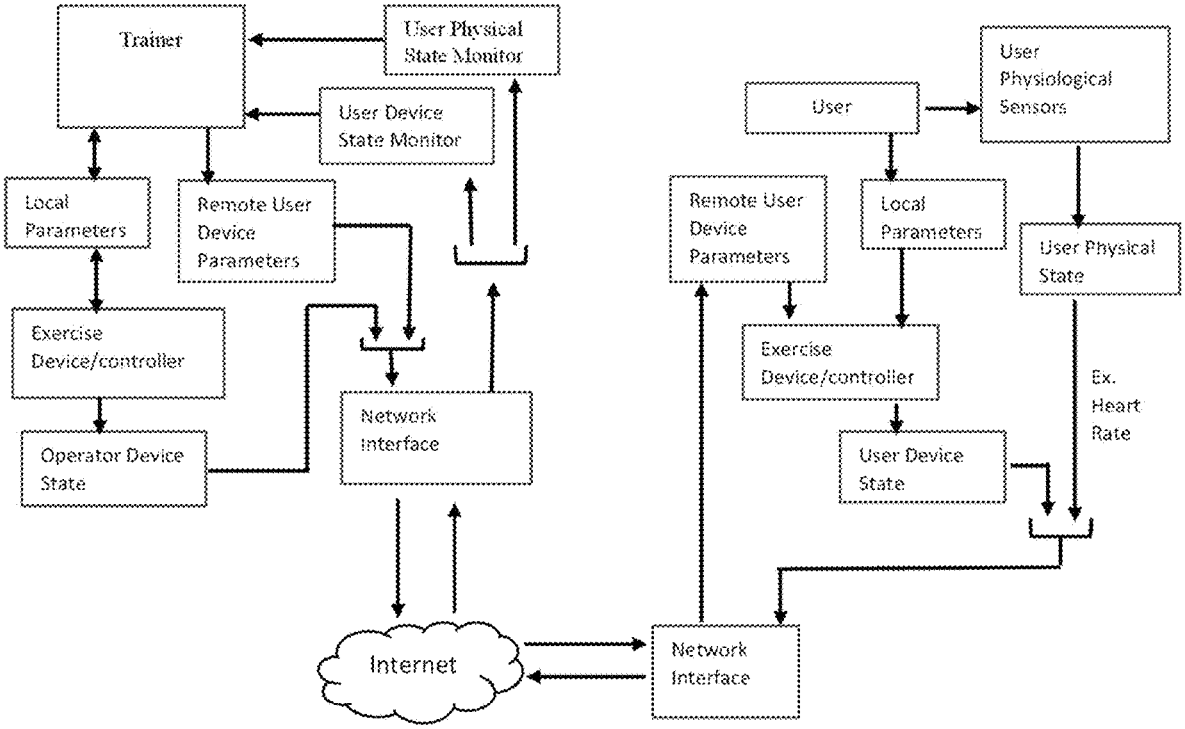
FIG. 1 (Prior Art)
FIG. 1 depicts a prior art remote trainer exercise system.

While this invention is illustrated and described in a preferred embodiment, the invention may be produced in many different configurations. There is depicted in the drawings, and will herein be described in detail, a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the present invention.

Note that in this description, references to "one embodiment" or "an embodiment" mean that the feature being referred to is included in at least one embodiment of the invention. Further, separate references to "one embodiment" in this description do not necessarily refer to the same embodiment; however, neither are such embodiments mutually exclusive, unless so stated and except as will be readily apparent to those of ordinary skill in the art. Thus, the present invention can include any variety of combinations and/or integrations of the embodiments described herein.

Figure 4:
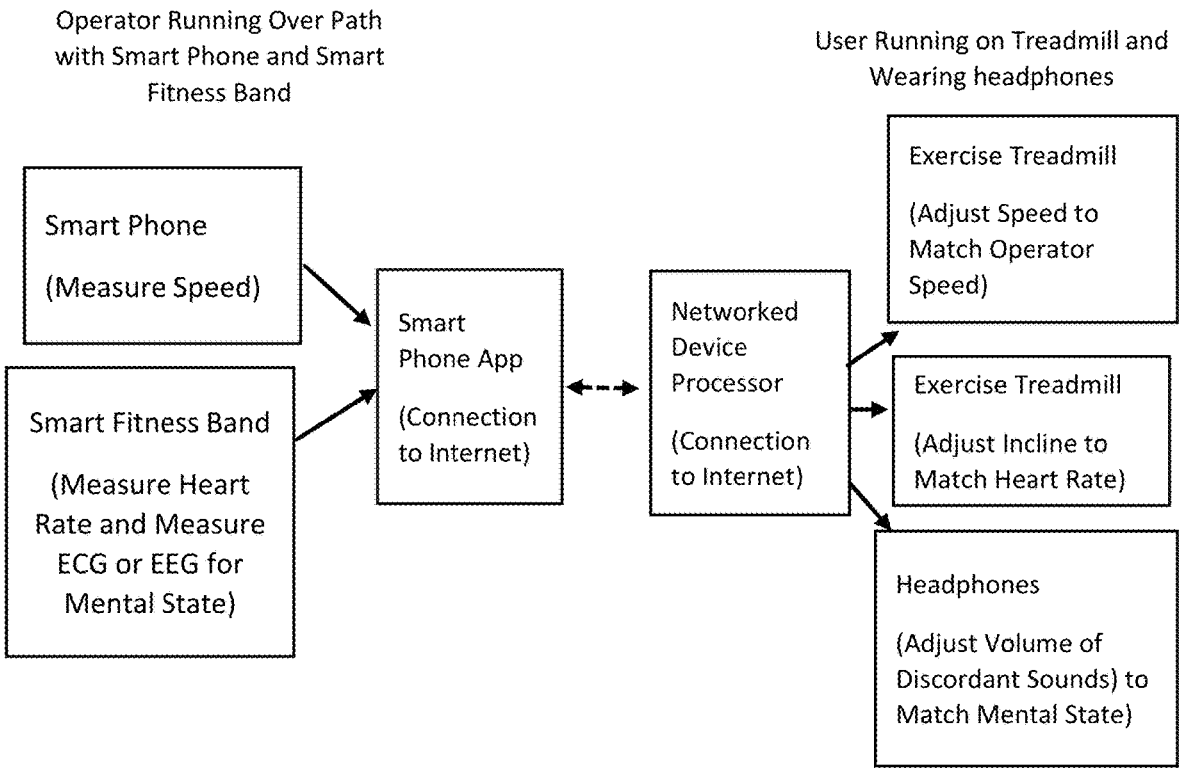
FIG. 4 depicts an example system showing Operator and User along with sensors and stimulator according to the present invention.

A person's biological condition is comprised of both a physical state and a mental state. FIG. 4 shows an embodiment of the present invention that includes the mirroring of the Operator's mental and physical state. There are numerous ways to measure and infer the Operator's mental state and the types of sensors used or computations employed do not change the intent of this invention. For example, studies in the literature have correlated mental state with variations in brain wave emissions measured by Electroencephalogram (EEG), Electrocardiogram (ECG), and Blood Pressure (BP) (see, for example, the papers to Munia et al. titled "Mental States Estimation with the Variation of Physiological Signals," the details of which are hereby incorporated herein by reference, and the paper to Kitagawa et al. titled "Mental States Estimation Using ECG Affected by Mood Change During Imagining the Near Future," the details of which are hereby incorporated herein by reference). While studies such as these show that a correlation between biomarkers and mental state exists, how best to determine human mental state from physiological data is an active area of research and many approaches exist. Since the human state of high anxiety can result in heart palpitations, measurement of changes in heart rate can be used to indicate this state. Because heart rate also changes with increased physical exertion, one method to differentiate physical stress from anxiety is to accumulate a buffer of heart measurements in real-time, calculate a moving average of heart rate, and then calculate a moving window of statistical variance. The slowly changing average heart rate will indicate increased physical activity while the heart rate variability as quantified by heart rate variance will indicate elevated anxiety. While heart rate is mentioned as an example, other parameters may be used without departing from the scope of the present invention. For example, any of the following (or combinations thereof) may be used: skin conductance, breathing rate and respiratory patterns, aerobic state, blood oxygen level, brain wave emissions, stress measurements, calories, ocular patterns, gait patterns and deviations, stride length, foot impact, body movement, audible and emitted sound patterns, gripping pressure and patterns, scent patterns, body posture, or visual indicator parameters derived from combinations of measurements and calculations.

EEG measurements can be used to indicate the human state as well. electrodes consisting of small metal discs that are dry electrodes are pressed against the scalp. The electrodes detect tiny electrical charges that result from the activity of brain cells and amplified signals proportional to brain activity can be stored or processed in real-time. By means of the Fourier transform, the power spectrum from the EEG signal is derived. Brain waves have been categorized into four basic groups:—beta (>13 Hz), —alpha (8-13 Hz), —theta (4-8 Hz), —delta (0.5-4 Hz). EEG is sensitive to a continuum of states ranging from stress state, alertness to resting state, hypnosis, and sleep. The brain energy ratio of $\alpha/\beta$ is believed to be a reasonable mental fatigue indicator.

Not addressed in the referenced papers, to increase accuracy and reduce sensitivity to confounding factors, a multimodal approach can be taken that utilizes the signals from several biomarkers to deduce the human state. The signals can be combined in many ways including AND/OR logic (e,g., if heart rate variability is high and a brain wave activity is low, then anxiety is high). Fuzzy logic inferencing can be used to account for variations in classifications since the human state and biomarkers are not fixed. This approach is described in pending U.S. application Ser. No. 16/851,051 ("Intelligent Closed-Loop Feedback Control for Transcranial Stimulation"), co-invented by this author. Other methods such as machine learning and neural networks can also be applied. The methods used do not alter the spirit of this invention since the sensor data is available and any signal conditioning and calculations can be performed that result in a classification of mental state.

However derived, the Operator's mental state such as "relaxed" is sent over the Internet to the Immersion Controller.

The Immersion Controller also receives an estimate of the User's mental state, forms an error signal, and uses a closed loop controller with some type of User Stimulator to move the User's mental state toward that of the Operator. For example, user stimulation to influence mental state could be playing soothing music if the User needs to be pacified or playing discordant sounds if the User's mental state needs to be antagonized.

Figure 2:
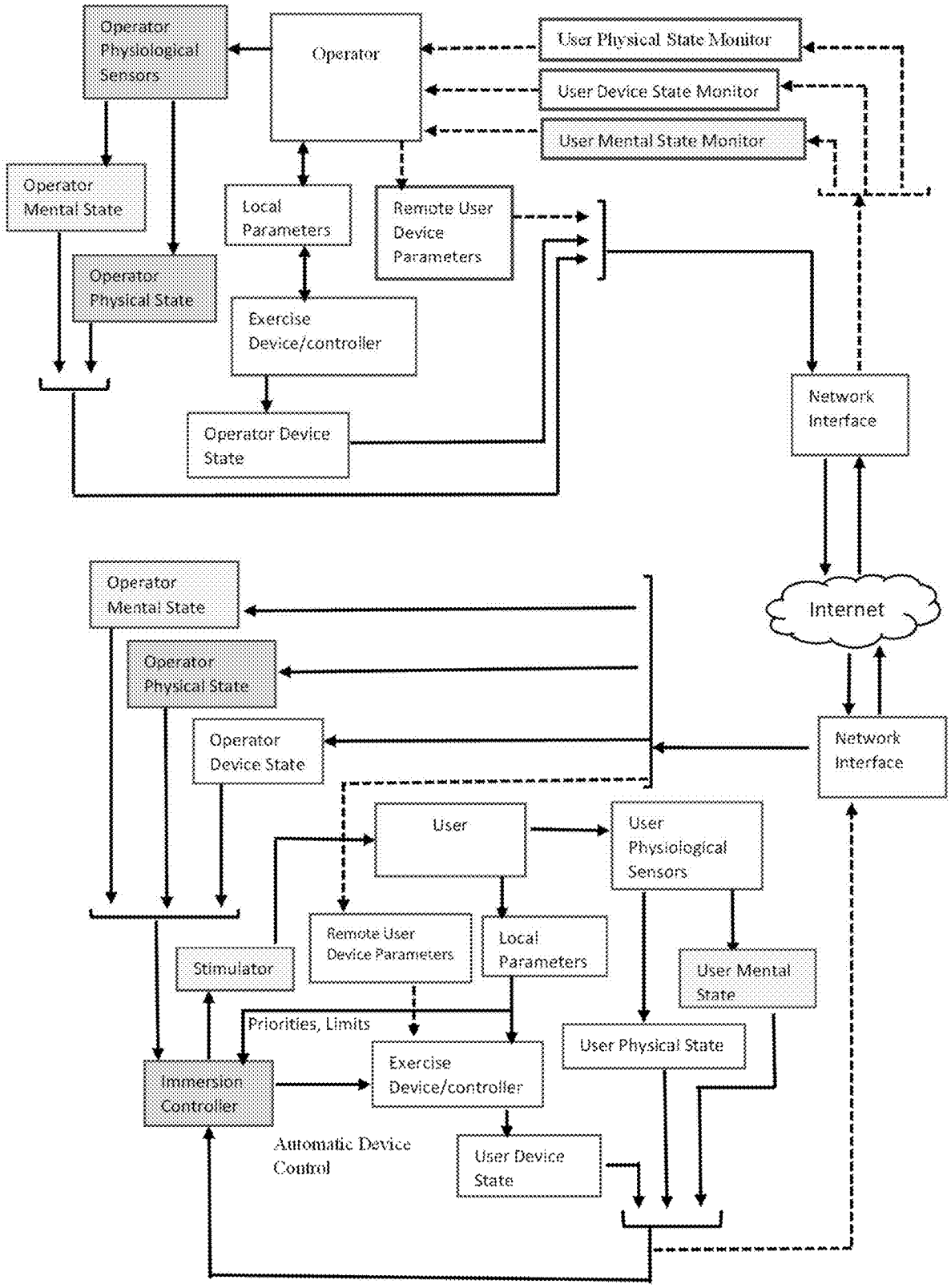
FIG. 2 depicts an embodiment of the present invention with remote mental and physical state tracking.

Ongoing studies in the field also suggest methods of noninvasive brain stimulation could be used for this purpose (see, for example, papers to Peltier et al. entitled, "Developing the Third Offset: Transcranial Direct Current Stimulation Can Improve the Human Operator," and Dittert et al. entitled, "Augmentation of Fear Extinction by Transcranial Direct Current Stimulation (tDCS)," both of which are hereby incorporated by reference) or perhaps stimulation based on a sense of smell or optical stimulation based on videos. The spirit of this invention is not changed by the method of stimulation or the number of combinations of stimulations applied. The essence of this invention is that the User's mental state is tracking that of the Operator in real-time thus the User is mirroring the Operator's experience. Human state or mental state as used herein includes one of, or a combination of, the following: calm, relaxed, fatigued, attention span, anxiety, depression, fear, alert, engaged, cognitive acuity, or gradations there in between On the user side of the Internet interface, the Operator's Physical State and Mental State are sent to the Immersion Controller. The Immersion Controller is responsible for signals sent to the User's Exercise Device/Controller such that the Operator Physical State and/or the Operator Mental State information is tracked by the User and/or the User's exercise device. FIG. 2 shows the present invention's Immersion Controller that includes a control channel for the mental state, a control channel for the device state, a control channel for the physical state, and combinations thereof. The operator can be located in a geographically different spot than the user. The operator's physical state (labeled "Operator Physical State") can be measured (using, for example, the Operator Physiological Sensors) in situ, and the Operator Device State may also be simultaneously measured (e.g., as measured by the Exercise/Device Controller). For example, in the case of an exercise bike that may be a stationary exercise bike or an actual bike where the user is participating in an event outside, the heart rate and pedal power of the operator can be measured along with the speed and incline of the bike being used in the event. Those measurements can be collected automatically without interference from the operator. In general, one or more operator physiological sensors such as heart rate, skin conductance, skin temperature, blood oxygenation level, ECG, EEG sensors, etc. can be used to gather physiological data. That data is conditioned and may be used individually or in mathematical or heuristic combinations in the Operator Physical State to provide estimates of the Operator's physiological state. Those versed in the state of the art will recognize the types of physiological sensors available and the use of multimodalities and multiple sensors to improve the accuracy of the operator's physiological state estimation In one non-limiting example, the mental state is described using a continuous numerical value on a sliding scale with Agitated being a 10 and Calm being a 0. A positive Mental State Error means that the remote operator is more agitated than the local user. This would result in a higher volume of discordant sounds being played in the User's environment and, hence, move the user toward a higher state of agitation to mirror that of the remote operator.

Figure 3:
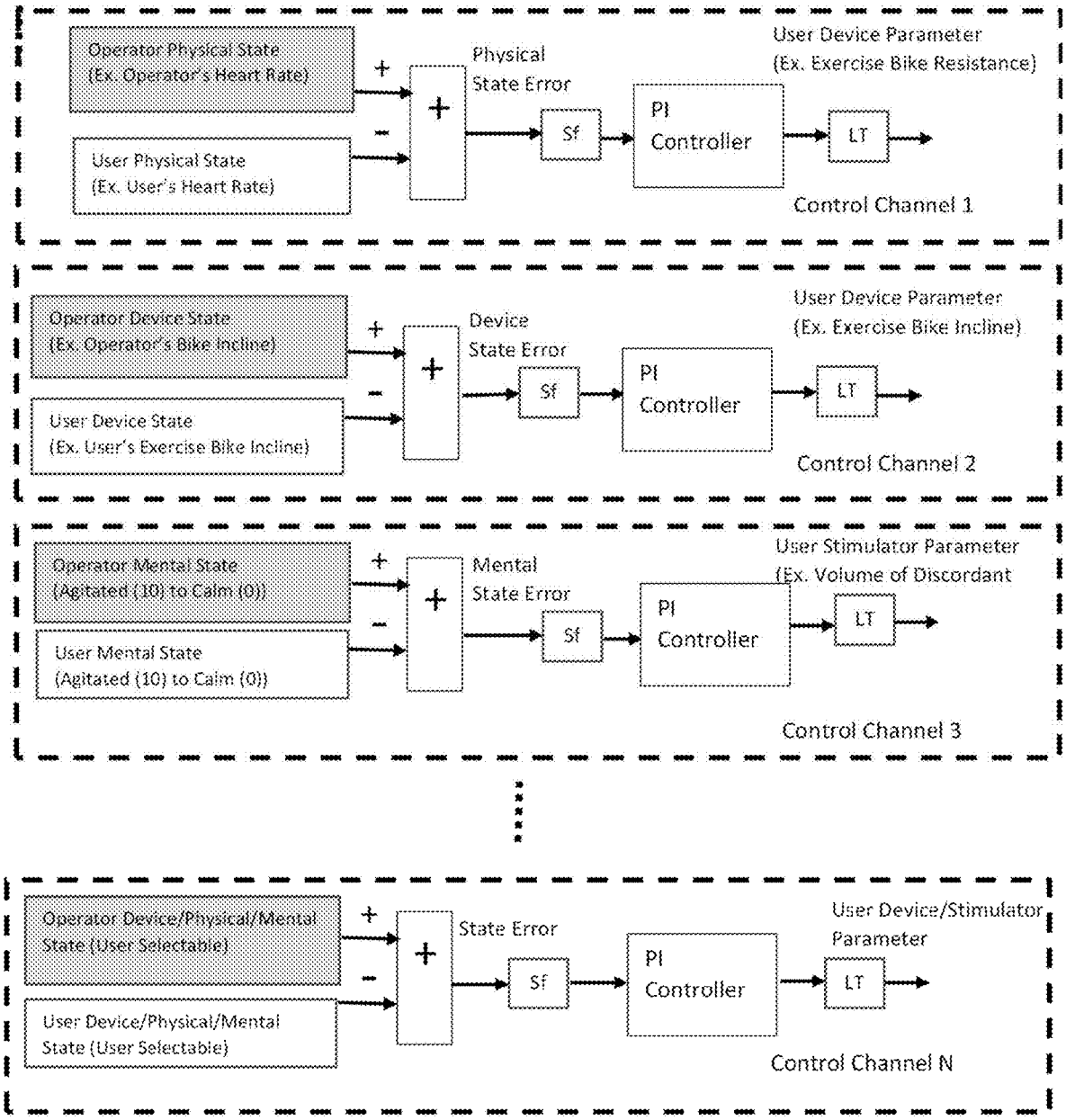
FIG. 3 depicts an embodiment of an Immersion Control that includes a control channel for mental state.

One embodiment of the Immersion Controller is shown in FIG. 3. It consists of one or more control channels in which each control channel sends commands to the User Exercise Device/Controller to make adjustments such that the state of the User tracks the physical, device, and/or mental state of the Operator. The blocks with "+" are summation, and the PI Controller is shown in standard form. Those versed in the state of the art will recognize the PI controller and understand that other types of controllers can be used in its place. To prioritize control channels, a scale factor Sf can be used to speed up or slow down the controllers' response times. This can be useful when more than one control channel affects the user's state. Sf greater than one tends to speed up response on that control channel while Sf less than one tends to slow down the response of that control channel. Other methods of reducing loop interactions can be found in the literature on control systems. The LT block on the output of the PI Controller represents an output limiter that can be used to bound the output command within safe and desirable limits. Other methods of output limiting can be found in the literature on control systems.

Control Channel 1 inputs a numerical value representing the Operator Physical State, for example the Operator's Heart Rate, and subtracts it from a numerical value representing the User Physical State, the User's Heart Rate, to generate a Physical State Error. Whenever the Operator's heart rate is faster than the User's heart rate, the Physical State Error is positive. That error is input to a control algorithm such as a PI Controller to generate a signal that changes the User Device Parameter. In this example, the User's exercise bike resistance is increased when that error is positive. Increasing the bike's resistance will cause the User to exert more effort on the bike and thus increase the User's heart rate (see, for example, the article by J. Schwartz titled "The Speed and Incline of the Treadmill and the Effect on Burning Calories"). This closed-loop control channel will continuously adjust the bike's resistance such that the User's heart rate will track that of the Operator.

It should be noted that the PI Controller is known to those versed in the state of the art for control systems and other types of control systems also known to those versed in the state of the art for controls can be used without changing the overall operation of the system. It should also be noted that the example of an exercise bike is for clarity of the present discussion. Still, other types of user devices could be used such as treadmills, stair masters, rowing machines, elliptical devices, variable resistance climbers, vibration platforms, etc. without changing the effectiveness or the spirit of the invention.

Control Channel 2 inputs the Operator Device State, for example, the Operator's Bike incline and subtracts it from the User Device State, the User's Bike incline, to generate a Device State Error. Whenever the Operator's bike incline is higher than the User's bike incline, the Device State Error is positive. That error is input to a control algorithm such as a PI Controller to generate a signal that changes the User Device Parameter. In this example, the User's exercise bike incline is increased. This closed-loop control channel will continuously adjust the bike's incline such that the User's bike incline will track that of the Operator.

It should be noted that the PI Controller is known to those versed in the state of the art for control systems and other types of control systems also known to those versed in the state of the art for controls can be used without changing the overall operation of the system. Other types of control systems such as optimal control, deep learning, neural networks or artificial intelligence, fuzzy logic, or model-based control, adaptive control, and nonlinear control among others.

Control Channel 3 inputs the Operator Mental State, for example, the Operator is agitated or calm, and subtracts it from the User Mental State, to generate a Mental State Error. That error is input to a control algorithm such as a PI Controller to generate a signal that changes the User Stimulator Parameter (e.g., when the user is relaxed but the operator is agitated, discordant music may be played). This closed-loop control channel will continuously adjust the User Stimulator Parameter such that the User's Mental State will track that of the Operator.

It should also be noted that the example of an exercise bike is for clarity of discussion. Still, other types of user devices could be used such as treadmills, stair masters, rowing machines, elliptical devices, variable resistance climbers, vibration platforms, etc. without changing the effectiveness or the spirit of the invention.

FIG. 4 shows an example application of this invention in which an Operator is running over a path. The Operator has a commercially available smartphone and Smart Fitness Band. The smartphone can measure speed based on GPS location and the smart fitness band can measure heart rate while on the wrist. This information can be sent via a smartphone app over the Internet to a remote user. The remote User is on a treadmill that is network enabled and connected to the Internet. The treadmill can adjust its speed via an electric motor. The incline is also adjustable via a small incline motor. The user is wearing headphones or wireless headphones with a user-based selection of music or sounds that the user finds to be discordant. The Device Processor can adjust the volume of the sounds and selection playlist heard by the user over the headphones. This is an example of a complete system that is an implementation of this invention using commonly available components. This system mirrors the Operators experience in real-time to the User via in-situ physiological and device measurements.

Note that the operator need not have any exercise equipment as long as the physical and mental states are measured. Note too, that if the operator is using exercise equipment, that the remote user does not need to be using the same equipment as long as corresponding physical and mental states can be measured and, on the remote side, affected by the equipment.

Similarly, if this application was for an operator on a bike, then a pedal power sensor would be added to the bikes if power mirroring was desired. In that case, the Immersion controller would adjust bike resistance for the user to match the power being exerted by the operator. Heart rate could also be adjusted via bike incline, and mental state could be mirrored using the headphones.

It should also be noted that although the system is capable of directly mirroring the Operator's physiological state to the User, it may be desirable to track the Operator's state but at a lesser level or higher level depending upon the relative fitness between the Operator and the User. Thus, without loss of generality, the system can track a function of the Operator's physical, mental, and device state. That function can follow the Operator but may be at a scaled-down or up value as desired. It may also be desirable to mirror or track a subset of the available parameters. The present invention is capable of allowing selections of parameters and this is within the spirit of the present invention.

It should be noted that this invention does not restrict the system such that a remote operator is necessary. In another embodiment, in the absence of a remote operator, the local User can set a desired target physiological state and mental state in place of the physiological state and mental state from the remote Operator. In that case, the closed-loop system will adjust the local device in order to track the desired target setpoint or profile. For example, the local User could set a particular heart rate and a calm mental state as his/her target heart rate and mental state that he/she wants to reach on the bike. The bike's resistance would be varied automatically by the immersion controller in order to track the desired heart rate profile such that his/her own heart rate follows the profile. Sound in headphones would be varied to track the desired calm mental state.

In one embodiment, the present invention provides an automated biofeedback system comprising: a processor; a first set of sensors, the first set of sensors monitoring a physical state associated with an operator and outputting a first set of parameters representing the physical state associated with the operator; a second set of sensors, the second set of sensors monitoring a mental state associated with the operator and outputting a second set of parameters representing the mental state associated with the operator; a network interface forwarding both the first set of parameters and the second set of parameters to a remote user, and wherein an immersion controller associated with a remote user, located remote from the operator, receives the first set of parameters associated with the physical state of the operator and the second set of parameters representing the mental state associated with the operator, and generates one or more device parameters to control a local exercise device associated with the remote user based on the received first set of parameters and second set of parameters.

In another embodiment, the present invention provides an automated biofeedback system comprising: (a) a network interface associated with a user's exercise device receiving a first set of parameters and a second set of parameters, the first set of parameters representing a first physical state associated with a remote operator and the second set of parameters representing a first mental state associated with the remote operator; (b) an immersion controller associated with the user's exercise device, the immersion controller: (i) receiving the first set of parameters and the second set of parameters from the network interface; (ii) receiving a third set of parameters from an exercise device controller associated with the user's exercise device, the third set of parameters representing a second physical state associated with the user of the exercise device; (iii) receiving a fourth set of parameters representing a second mental state associated with the user of the exercise device; (iv) computing a fifth set of parameters from inputs received (i) through (iii), and (v) transmitting the fifth set of parameters to the exercise device controller; (c) the exercise device controller setting a sixth set of parameters in the local exercise device based on the received fifth set of parameters, the sixth set of parameters allowing the local exercise device to track both the first physical state of the remote operator and the first mental state of the remote operator.

In yet another embodiment, the present invention provides an automated biofeedback system comprising: (a) a network interface receiving a first set of parameters and a second set of parameters, the first set of parameters representing a first physical state associated with a remote operator and the second set of parameters representing a first mental state associated with the remote operator; (b) an immersion controller associated with a local exercise device, the immersion controller comprising at least a first control channel and a second control channel, the first control channel receiving as input: the first set of parameters representing the first physical state associated with the remote operator and a third set of parameters representing a second physical state associated with a user of the local exercise device, and outputting a first control channel output; and the second control channel receiving as input: the second set of parameters representing the first mental state associated with the remote operator and a fourth set of parameters representing the second mental state associated with the user of the local exercise device and outputting second control channel output, wherein the immersion controller outputs the first control channel output and the second control channel output to an exercise device controller; and (c) the exercise device controller setting a fifth set of parameters in the local exercise device based on the received first and second control channel outputs, the fifth set of parameters allowing the local exercise device to track both the first physical state of the remote operator and the first mental state of the remote operator such that the user of the local exercise device is immersed in an experience of the remote operator.

The above-described features and applications can be implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Embodiments within the scope of the present disclosure may also include tangible and/or non-transitory computer-readable storage media for carrying or having computer-executable instructions or data structures stored thereon. Such non-transitory computer-readable storage media can be any available media that can be accessed by a general purpose or special purpose computer, including the functional design of any special purpose processor. By way of example, and not limitation, such non-transitory computer-readable media can include flash memory, RAM, ROM, EEPROM, CD-ROM or other optical disk storage, magnetic disk storage or other magnetic storage devices, or any other medium which can be used to carry or store desired program code means in the form of computer-executable instructions, data structures, or processor chip design. The computer readable media does not include carrier waves and electronic signals passing wirelessly or over wired connections.

Computer-executable instructions include, for example, instructions and data which cause a general-purpose computer, special purpose computer, or special purpose processing device to perform a certain function or group of functions. Computer-executable instructions also include program modules that are executed by computers in standalone or network environments. Generally, program modules include routines, programs, components, data structures, objects, and the functions inherent in the design of special-purpose processors, etc. that perform particular tasks or implement particular abstract data types. Computer-executable instructions, associated data structures, and program modules represent examples of the program code means for executing steps of the methods disclosed herein. The particular sequence of such executable instructions or associated data structures represents examples of corresponding acts for implementing the functions described in such steps.

Processors suitable for the execution of a computer program include, by way of example, both general and special purpose microprocessors, and any one or more processors of any kind of digital computer. Generally, a processor will receive instructions and data from a read-only memory or a random-access memory or both. The essential elements of a computer are a processor for performing or executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. However, a computer need not have such devices. Moreover, a computer can be embedded in another device.

In this specification, the term "software" is meant to include firmware residing in read-only memory or applications stored in magnetic storage or flash storage, for example, a solid-state drive, which can be read into memory for processing by a processor. Also, in some implementations, multiple software technologies can be implemented as sub-parts of a larger program while remaining distinct software technologies. In some implementations, multiple software technologies can also be implemented as separate programs. Finally, any combination of separate programs that together implement a software technology described here is within the scope of the subject technology. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a standalone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

These functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, for example microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic or solid state hard drives, read-only and recordable Blu-Ray® discs, ultra density optical discs, any other optical or magnetic media, and floppy disks. The computer-readable media can store a computer program that is executable by at least one processing unit and includes sets of instructions for performing various operations. Examples of computer programs or computer code include machine code, for example is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, for example application specific integrated circuits (ASICs) or field programmable gate arrays (FPGAs). In some implementations, such integrated circuits execute instructions that are stored on the circuit itself.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

It is understood that any specific order or hierarchy of steps in the processes disclosed is an illustration of example approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components illustrated above should not be understood as requiring such separation, and it should be understood that the described program components and systems can generally be integrated together in a single software product or packaged into multiple software products.

Various modifications to these aspects will be readily apparent, and the generic principles defined herein may be applied to other aspects. Thus, the claims are not intended to be limited to the aspects shown herein, but is to be accorded the full scope consistent with the language claims, where reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject technology.

A phrase, for example, an "aspect" does not imply that the aspect is essential to the subject technology or that the aspect applies to all configurations of the subject technology. A disclosure relating to an aspect may apply to all configurations, or one or more configurations. A phrase, for example, an aspect may refer to one or more aspects and vice versa. A phrase, for example, a "configuration" does not imply that such configuration is essential to the subject technology or that such configuration applies to all configurations of the subject technology. A disclosure relating to a configuration may apply to all configurations, or one or more configurations. A phrase, for example, a configuration may refer to one or more configurations and vice versa.

The various embodiments described above are provided by way of illustration only and should not be construed to limit the scope of the disclosure. Those skilled in the art will readily recognize various modifications and changes that may be made to the principles described herein without following the example embodiments and applications illustrated and described herein, and without departing from the spirit and scope of the disclosure.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

As noted above, particular embodiments of the subject matter have been described, but other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

CONCLUSION

A system and method have been shown in the above embodiments for the effective implementation of a system, method and article of manufacture for remote immersive physiological tracking using operator physical state and operator mental state. While various preferred embodiments have been shown and described, it will be understood that there is no intent to limit the invention by such disclosure, but rather, it is intended to cover all modifications falling within the spirit and scope of the invention, as defined in the appended claims. For example, the present invention should not be limited by software/program, computing environment, or specific computing hardware.

The invention claimed is:

1. A system comprising:

a processor;

a first set of sensors, the first set of sensors configured to monitor a physical state associated with an operator and outputting a first set of parameters representing the physical state associated with the operator;

a second set of sensors, the second set of sensors configured to monitor a mental state associated with the operator and outputting a second set of parameters representing the mental state associated with the operator;

a network interface configured to forward both the first set of parameters and the second set of parameters to a remote user, and wherein an immersion controller associated with a remote user, located remote from the operator, is configured to receive the first set of parameters associated with the physical state of the operator and the second set of parameters representing the mental state associated with the operator, and is configured to generate one or more device parameters to control a local exercise device associated with the remote user based on the received first set of parameters and second set of parameters.

2. The system of claim 1, wherein the operator is a trainer.

3. The system of claim 1, wherein the first and second sets of parameters are forwarded over the Internet.

4. The system of claim 1, wherein the local exercise device are picked from any of the following: a bike, a treadmill, a rowing machine, an elliptical bike, a stair master, a variable resistance climber, or vibration platform.

5. The system of claim 1, wherein the first set of parameters representing the physical state associated with the operator are detected via in-situ noninvasive measurements.

6. The system of claim 1, wherein the first set of parameters are any of, or a combination of, the following: heart rate, skin conductance, breathing rate and respiratory patterns, aerobic state, blood oxygen level, brain wave emissions, stress measurements, calories, ocular patterns, gait patterns and deviations, stride length, foot impact, body movement, audible and emitted sound patterns, gripping pressure and patterns, scent patterns, body posture, or visual indicator parameters derived from combinations of measurements and calculations.

7. The system of claim 1, wherein the second set of parameters are any human state including one of, or a combination of, the following: calm, relaxed, fatigued, attention span, anxiety, depression, fear, alert, engaged, cognitive acuity or gradations there in between.

8. A system comprising:

(a) a network interface associated with a user's exercise device configured to receive a first set of parameters and a second set of parameters, the first set of parameters representing a first physical state associated with a remote operator and the second set of parameters representing a first mental state associated with the remote operator;

(b) an immersion controller associated with the user's exercise device, the immersion controller configured to: (i) receive the first set of parameters and the second set of parameters from the network interface; (ii) receiving-receive a third set of parameters from an exercise device controller associated with the user's exercise device, the third set of parameters representing a second physical state associated with the user of the exercise device; (iii) receive-a fourth set of parameters representing a second mental state associated with the user of the exercise device; (iv) compute a fifth set of parameters from inputs received (i) through (iii), and (v) transmit the fifth set of parameters to the exercise device controller;

(c) the exercise device controller configured to set a sixth set of parameters in the user's exercise device based on the received fifth set of parameters, the sixth set of parameters allowing the local exercise device to track both the first physical state of the remote operator and the first mental state of the remote operator.

9. The system of claim 8, wherein the immersion controller comprises:

at least a first and second control channels;

the first control channel receiving as input: the first set of parameters representing the first physical state associated with a remote operator and the third set of parameters representing the second physical state associated with a user of the exercise device and outputting a seventh set of parameters; and the second control channel receiving as input: the second set of parameters representing the first mental state associated with the remote operator and the fourth set of parameters representing the second mental state associated with the user of the exercise device and outputting an eighth set of parameters, wherein the seventh set of parameters and the eight set of parameters collectively comprise the fifth set of parameters.

10. The system of claim 9, wherein each control channel comprises a proportional integral (PI) controller.

11. The system of claim 8, wherein the remote operator is a trainer.

12. The system of claim 8, wherein the first and second sets of parameters are received over the Internet.

13. The system of claim 8, wherein the remote exercise device and the local exercise device are picked from any of the following: a bike, a treadmill, a rowing machine, an elliptical bike, a stair master, a variable resistance climber, or a vibration platform.

14. The system of claim 13, wherein the remote exercise device is different than the local exercise device.

15. The system of claim 8, wherein the first set of parameters representing the first physical state associated with the remote operator and the third set of parameters representing the second physical state associated with the user of local exercise device are detected via in-situ noninvasive measurements.

16. The system of claim 8, wherein the first set of parameters are any of, or a combination of, the following: heart rate, skin conductance, breathing rate and respiratory patterns, aerobic state, blood oxygen level, brain wave emissions, stress measurements, calories, body temperature, ocular patterns, gait patterns and deviations, stride length, foot impact, body movement, audible and emitted sound patterns, gripping pressure and patterns, scent patterns, body posture, or visual indicators parameters derived from combinations of measurements and calculations.

17. The system of claim 8, wherein the second set of parameters are any of, or a combination of, the following: power, incline, speed, acceleration, distance, resistance, vibration, and step size.

18. A system comprising:

(a) a network interface configure to receive a first set of parameters and a second set of parameters, the first set of parameters representing a first physical state associated with a remote operator and the second set of parameters representing a first mental state associated with the remote operator;

(b) an immersion controller associated with a local exercise device, the immersion controller comprising at least a first control channel and a second control channel, the first control channel configured to receive as input: the first set of parameters representing the first physical state associated with the remote operator and a third set of parameters representing a second physical state associated with a user of the local exercise device, and outputting a first control channel output; and the second control channel configured to receive as input: the second set of parameters representing the first mental state associated with the remote operator and a fourth set of parameters representing the second mental state associated with the user of the local exercise device and outputting second control channel output, wherein the immersion controller is configured to output the first control channel output and the second control channel output to an exercise device controller; and (c) the exercise device controller is configured to set a fifth set of parameters in the local exercise device based on the received first and second control channel outputs, the fifth set of parameters allowing the local exercise device to track both the first physical state of the remote operator and the first mental state of the remote operator such that the user of the local exercise device is immersed in an experience of the remote operator.

19. The system of claim 18, wherein each control channel comprises a proportional integral (PI) controller.

20. The system of claim 18, wherein the remote operator is a trainer.

21. The system of claim 18, wherein the first and second sets of parameters are received over the Internet.

22. The system of claim 18, wherein the remote exercise device and the local exercise device are picked from any of the following: a bike, a treadmill, a rowing machine, an elliptical bike, a stair master, a variable resistance climber, or a vibration platform.

23. The system of claim 22, wherein the remote exercise device is different than the local exercise device, and wherein the remote exercise device is a computing device that measures physiological and/or mental and/or physical measurements for transmission to the local device.

24. The system of claim 18, wherein the first set of parameters representing the first physical state associated with the remote operator and the third set of parameters representing the second physical state associated with the user of local exercise device are detected via in-situ noninvasive measurements.

25. The system of claim 18, wherein the first set of parameters are any of, or a combination of, the following: heart rate, skin conductance, breathing rate and respiratory patterns, aerobic state, blood oxygen level, brain wave emissions, stress measurements, calories, body temperature, ocular patterns, gait patterns and deviations, stride length, foot impact, body movement, audible and emitted sound patterns, gripping pressure and patterns, scent patterns, body posture, or visual indicator parameters derived from combinations of measurements and calculations.

26. The system of claim 18, wherein the second set of parameters are any of, or a combination of, the following: power, incline, speed, acceleration, distance, resistance, vibration, and step size.

* * * * *